US010948256B2

(12) United States Patent
McDonald et al.

(10) Patent No.: US 10,948,256 B2
(45) Date of Patent: Mar. 16, 2021

(54) LARGE BORE GUN CLEANING APPARATUS WITH EXPANDING DISC MANDRELS

(71) Applicant: Otis Products, Inc., Lyons Falls, NY (US)

(72) Inventors: John L. McDonald, Phoenix, NY (US); James R. Brooker, Constantia, NY (US)

(73) Assignee: Otis Products, Inc., Lyons Falls, NY (US)

( * ) Notice: Subject to any disclaimer, the term of this patent is extended or adjusted under 35 U.S.C. 154(b) by 205 days.

(21) Appl. No.: 16/153,921

(22) Filed: Oct. 8, 2018

(65) Prior Publication Data

US 2019/0107357 A1 Apr. 11, 2019

Related U.S. Application Data

(60) Provisional application No. 62/569,905, filed on Oct. 9, 2017.

(51) Int. Cl.

| | |
|---|---|
| ***F41A 29/02*** | (2006.01) |
| ***B08B 9/00*** | (2006.01) |
| ***B08B 9/043*** | (2006.01) |

(52) U.S. Cl.

CPC ..... *F41A 29/02* (2013.01); *B08B 9/00* (2013.01); *B08B 9/0436* (2013.01); *B08B 2209/04* (2013.01)

(58) Field of Classification Search

CPC . F41A 29/00; F41A 29/02; B08B 9/04; B08B 9/043; B08B 9/0436

See application file for complete search history.

(56) References Cited

U.S. PATENT DOCUMENTS 849,786 A * 4/1907 Hildenbrand ..... F41A 29/02 15/104.19
2,495,793 A * 1/1950 Webb ..... F41A 29/02 15/104.18

(Continued)

FOREIGN PATENT DOCUMENTS

FR 383660 A * 3/1908 ..... B08B 9/0436

OTHER PUBLICATIONS

International Search Report and Written Opinion for Corresponding International Application No. PCT/US2018/054810, dated Feb. 4, 2019 (18 pgs).

*Primary Examiner* — Gabriel J. Klein
(74) *Attorney, Agent, or Firm* — Harris Beach PLLC

(57) ABSTRACT

A gun cleaning apparatus includes a central member and a plurality of disc mandrels. The central member passes through a hole in each of the disc mandrels. The plurality of disc mandrels is stacked adjacent to one another on the central member. An adjustable end stop has a linear position adjustable in a compression direction, from a first level of linear compression of the plurality of disc mandrels setting a first radii of the disc mandrels, to a second level of linear compression different than the first level of linear compression of the plurality of disc mandrels, setting a second radii of the disc mandrels different than the first radii. A coilable semi-ridged cable pull cord for a gun cleaning apparatus and a method of pulling a gun cleaning apparatus through a bore of a gun in a close quarters or limited space are also described.

19 Claims, 12 Drawing Sheets

(56) References Cited

U.S. PATENT DOCUMENTS

| | | | | |
|---|---|---|---|---|
| 2,601,691 | A | 7/1952 | Dyer | |
| 4,554,973 | A | 11/1985 | Shonrock et al. | |
| 4,749,320 | A | 6/1988 | Gutt | |
| 4,760,868 | A * | 8/1988 | Saxon | F16L 55/136 138/89 |
| 4,962,607 | A * | 10/1990 | Baldwin | F41A 29/02 15/104.165 |
| 7,559,364 | B2 * | 7/2009 | Bullard | E21B 23/06 166/179 |
| 7,757,756 | B2 * | 7/2010 | Bullard | E21B 23/06 166/181 |
| 8,459,611 | B2 | 6/2013 | Allen | |
| 9,134,087 | B2 | 9/2015 | Canham | |
| 2008/0141474 | A1 * | 6/2008 | Kapustin | F16L 55/30 15/104.066 |
| 2012/0313326 | A1 * | 12/2012 | Urakami | B08B 9/0436 277/500 |
| 2014/0082989 | A1 * | 3/2014 | Canham | F41A 29/02 42/95 |
| 2014/0318812 | A1 | 10/2014 | Moyes | |

* cited by examiner

LARGE BORE GUN CLEANING APPARATUS WITH EXPANDING DISC MANDRELS

CROSS-REFERENCE TO RELATED APPLICATIONS

This application claims priority to and the benefit of co-pending U.S. provisional patent application Ser. No. 62/569,905, LARGE BORE GUN CLEANING APPARATUS WITH EXPANDING DISC MANDRELS, filed Oct. 9, 2017, which application is incorporated herein by reference in its entirety.

FIELD OF THE APPLICATION

The application relates to a gun cleaning tool, particularly to a tool for cleaning the bore of the barrel of a gun.

BACKGROUND

The barrel of all guns must be cleaned on a regular basis to remove contaminants deposited by the burning of gun powder. Large bore guns, such as, for example, 155 mm military howitzers are particularly difficult to clean both because of the relatively large bore diameter and the length of the barrel compared to a small arms long gun.

SUMMARY

According to one aspect, a gun cleaning apparatus includes a central member and a plurality of disc mandrels. Each disc mandrel has a center cylindrical wall substantially perpendicular to a disc plane. The central member passes through a hole in each of the disc mandrels defined by the center cylindrical wall. The plurality of disc mandrels is stacked adjacent to one another on the central member. A central member end stop is disposed at one end of the central member against a first side of a first disc mandrel. An adjustable end stop is disposed on the central member about adjacent to a second side of a last disc mandrel. The adjustable end stop has a linear position adjustable in a compression direction, from a first level of linear compression of the plurality of disc mandrels setting a first radii of the disc mandrels in the disc plane, to a second level of linear compression different than the first level of linear compression of the plurality of disc mandrels, setting a second radii of the disc mandrels in the disc plane different than the first radii. At least one mechanical coupling is disposed at an end of the central member to accept a cord or rod.

In one embodiment, the central member includes a slotted shaft with at least two or more selectable circumferential notches and at least one snap ring as the adjustable end stop.

In another embodiment, the central member includes a rod having at least one threaded section and at least one nut as the adjustable end stop.

In yet another embodiment, each disc mandrel includes a width along an axis of the central member at about the center cylindrical wall which is at least two times greater than a width of an outer edge surface of the disc mandrel at an outside radius of the disc mandrel about in the disc plane.

In yet another embodiment, the central member includes a threaded rod or a rod threaded at least over a portion of the rod.

In yet another embodiment, the central member extends past the adjustable end stop through an abrasive element.

In yet another embodiment, the abrasive element includes a wire brush.

In yet another embodiment, the mechanical coupling includes an eyelet.

In yet another embodiment, the mechanical coupling includes a slot in an end of the central member and a pin.

In yet another embodiment, the mechanical coupling includes a clevis and pin.

In yet another embodiment, each disc mandrel of the plurality of disc mandrels includes two cup sections affixed to each other in the disc plane.

In yet another embodiment, each cup section includes a hollow part.

In yet another embodiment, each cup section includes a plurality of pins and sockets in the cup section mating surface in the disc plane, the pins and sockets alternating such that each pin of a first cup section fits into a corresponding hole of a second cup section when the first cup section and the second cup section are joined together to form the disc mandrel.

In yet another embodiment, each cup section includes one or more radial rib features.

In yet another embodiment, each cup section includes one or more radial slit features.

In yet another embodiment, the adjustable end stop includes a lock nut.

In yet another embodiment, the lock nut includes a nylon insert.

In yet another embodiment, the gun cleaning apparatus further includes a second mechanical coupling disposed at an opposite end of the central member to accept a cord or a rod.

In yet another embodiment, the gun cleaning apparatus further includes a coilable semi-ridged cable pull cord.

In yet another embodiment, the gun cleaning apparatus further includes a Chinese finger trap pull cord.

According to another aspect, a coilable semi-ridged cable pull cord for a gun cleaning apparatus includes a cable, a first end stop and a second end stop. Both end stops are non-slidingly coupled to the cable at different locations. A plurality of tubular sections is slidingly disposed on the cable between the first end stop and the second end stop. Each tubular section includes an end face about perpendicular to a long axis of the tubular section at each of both ends of the tubular section. At least one spring is disposed either between an end stop and a tubular section or disposed between two tubular sections. In a coiled position, the at least one spring is in a first compressed state. In a substantially straight position, the at least one spring is in a second compressed state with less spring force than the first compressed state.

In one embodiment, the coilable semi-ridged cable pull cord further includes one or more additional springs disposed between groups of tubular sections.

In another embodiment, the coilable semi-ridged cable pull cord further includes one or more additional springs disposed between a tubular section and an end stop.

In yet another embodiment, the coilable semi-ridged cable pull cord further includes past an end stop, a loop of cable formed by a crimp barrel and a metal thimble.

In yet another embodiment, the cable includes a wire cable or a coated wired cable.

According to another aspect, a method of pulling a gun cleaning apparatus through a bore of a gun in a close quarters or limited space includes: providing a Chinese finger trap coupled to a pull cord and a gun cleaning tool with a central member; sliding the Chinese finger trap over the central member of the gun cleaning tool; pulling way the gun cleaning tool at least part through a bore of a gun barrel in a gripping direction; advancing the Chinese finger trap along the central member in a sliding direction opposite to the gripping direction; and repeating the step of pulling and the step of advancing, until the gun cleaning tool is through the bore of the gun.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

Figure 1:
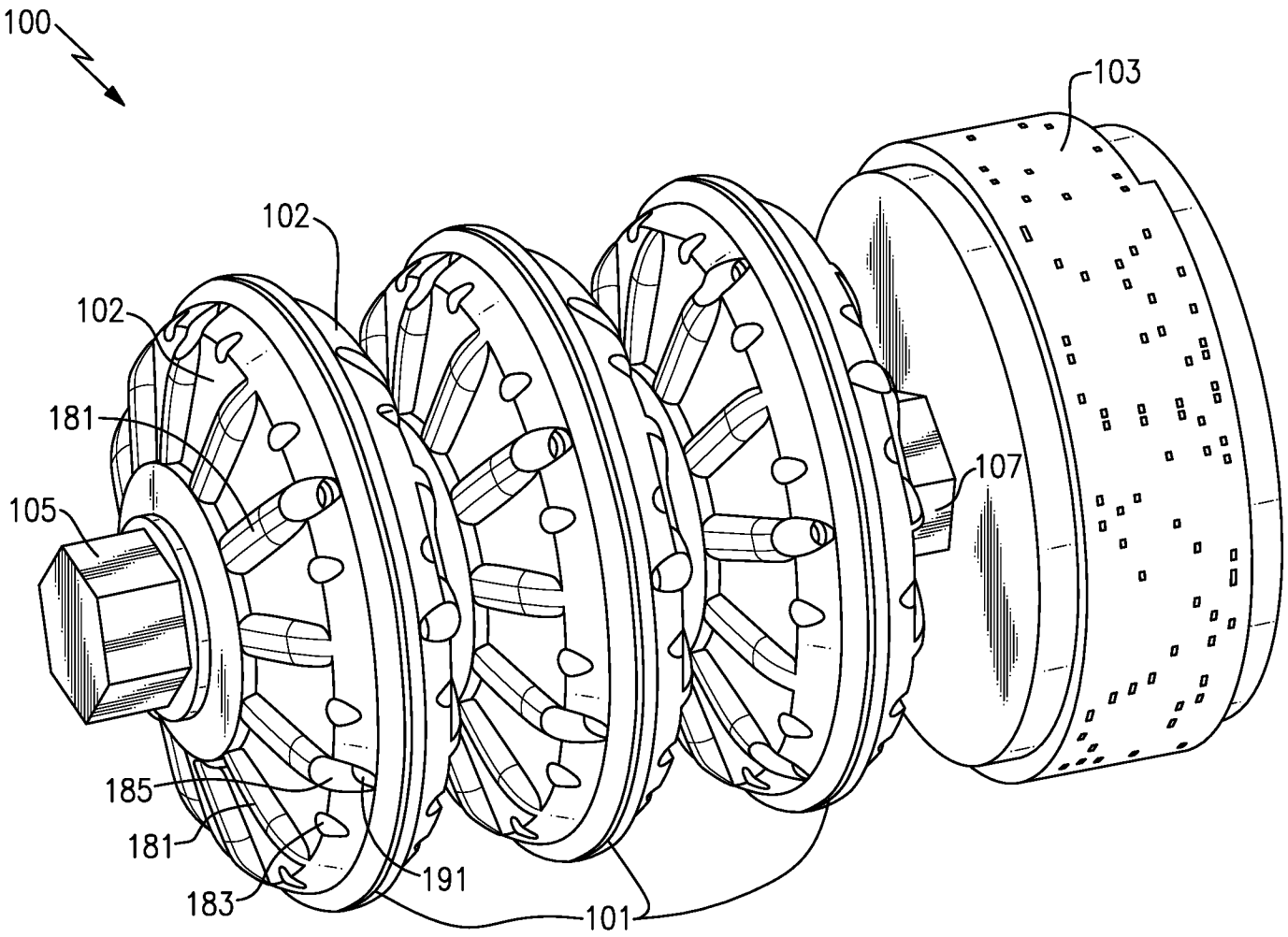
FIG. 1 is a drawing showing a perspective view of an exemplary gun cleaning mandrel and abrasive device assembly with expanding disc mandrels from a mandrel end.

U.S. Pat. No. 9,134,087 to Canham describes a device for cleaning a bore of a firearm. One or more bore-cleaning bodies may include a core and a fabric cover, and a central member used to compress the core longitudinally and expand it radially to apply radial force pressing the fabric cover against the interior bore surface. The cores of the '087 patent expand radially outward against the inside surface of a bore to be cleaned, however, while helpful, do not provide enough radial force. Because the expanding cores have substantially cylindrical shapes, the radial force due to linear compression of the cores is spread across a relatively large cylindrical contact area.

U.S. Pat. No. 9,658,021, MANDREL BASED HELICAL PULL THROUGH GUN CLEANING DEVICE, and U.S. Pat. No. 9,441,903, PULL THROUGH GUN CLEANING DEVICE WITH ONE OR MORE CYLINDRICAL DOUBLE CONED SHEATHED PRESSURE SECTIONS DESCRIBE GUN CLEANING TOOLS WITH MANDRELS, both assigned to the same assignee, OTIS Patent Trust, described mandrel based gun cleaning tools. However, the tools of the '021 and '903 patents use non-adjustable mandrel sections and may be less optimal for cleaning the barrels large bore military weapons, such as, for example, howitzers, and tank and ship guns. Both of the '021 and '903 patents are incorporated herein by reference in their entirety for all purposes.

U.S. Pat. No. 4,716,673, GUN BARREL CLEANER AND CONTAINER THEREFOR, also assigned to the OTIS Patent Trust, describes structures and materials for use in gun cleaning tools. The '673 patent is incorporated herein by reference in its entirety for all purposes.

What is needed to clean a relatively large bore weapon, is one or more a radial expanding cleaning sections that that can more closely conform to the interior surface, particularly rifled interior surfaces where the cleaning sections can more effectively push or force a cleaning sock into the crevices of a barrel rifling, as well as providing an effective wiping or swabbing action while pulled through the barrel.

Applicants realized that a solution is to provide expanding mandrels with substantially circular contact areas of relatively narrow width. Each mandrel on a central member has a relatively small length along the axis of the central member (e.g. a disc mandrel axial length) compared with the long cores of the prior art. Moreover, the substantially circular contact surface of each mandrel along a pull axis (the long axis of a barrel being cleaned), is relatively short compared with the length of the mandrel at a center of the mandrel along the central member. The solution provides a significantly higher radial force, and a more efficient wiping and swabbing action, especially when covered by a cleaning sock. The new gun cleaning tool of the Application includes a plurality of disc like mandrels which are wider at the center and which provide a relatively narrow circular contact surface with an inside surface of a barrel to be cleaned. By providing a somewhat hollow interior in each of the mandrels, when linearly compressed, as by a linear tension of a threaded rod or bolt, or a rod with selectable snap ring positions, the radius of the mandrel can be increased with increasing linear compression so that a contact force of the substantially circular mandrel contact surface against the inner bore surface can be increased. Focusing the conversion of the linear compression force to the relatively small circular contact surface of a plurality of mandrels provides the desired cleaning action for the more effective removal of contaminants such as carbon combustion by products, from the rifling of a gun barrel. The solution of the Application, while applicable to any sized barrel, and not limited to larger bore guns, was developed to clean big bore barrels, such as for example the barrels of large military guns, including guns such as, for example, Howitzers with barrel diameters of 85 mm, 105 mm, 120 mm, and 155 mm. The new disc mandrel gun cleaning apparatus is believed to be scalable without upper limit. The new structures and methods of the Application are suitable for use to clean the largest known gun barrel diameters.

Disc Mandrel and Abrasive Device Assembly

FIG. 1 shows a perspective view of an exemplary gun cleaning mandrel and abrasive device assembly 100 with expanding disc mandrels 101 and an abrasive device 103, typically a wire brush assembly. In the exemplary embodiment of FIG. 1, a hex head 105 is fixed mounted as a central member end stop to a rod (a central member) which includes threads in whole, or at least over a portion of the rod (rod and threads not visible in FIG. 1).

Threaded rod and nut: At least a section of the rod near a nut 107 is threaded with a threaded section wide enough to provide a sufficient linear range of motion to convert a linear compression of the disc mandrels 101 along a long axis of the central member into a change in radius of each of the compressed disc mandrels 101. Nut 107 can be a lock or a compression nut, such as, for example, a lock nut with a nylon insert well known to those skilled in the art. Nut 107 is rotated on the threaded section of the rod to linearly compress each of the disc mandrels 101 until a desired disc mandrel radius is set. Any suitable lock nut or lock means can be used so that when the gun cleaning mandrel and abrasive device assembly 100 is pulled and/or pushed through the bore of a gun the nut does not unintentionally rotate once the desired disc mandrel radius has been set. Nut 107 as the adjusting element in FIG. 1 is merely exemplary. The central member end stop can be a hex head 105, a nut, or any other suitable end stop. Also, as described hereinbelow, an exemplary alternative to a thread and nut adjustable end stop is a snap ring and slot arrangement.

Disc mandrels 101 can include one or more features to strengthen the disc mandrels, or to facilitate disc mandrel radius expansion with linear compression. For example, ribs 181 can strengthen the disc walls of the cup sections 102 of disc mandrels 101. Similarly dimples 183 can strengthen the outer edges of the cup sections 102. Reliefs 185 can provide openings for screws 191 which can be used to further couple and secure the two cup sections of each disc mandrel to each other. Slits (not shown in the drawings), such as, for example, any suitable radial slits can be made along the surfaces of cup sections 102 to facilitate the change in radius in the disc plane, with linear compression of the disc mandrels 101 along the axis of the central member.

It is unimportant how the linear force is provided to the disc mandrels 101 near where each disc mandrel is slid over the central member such as a rod threaded in part or in whole as, for example, a threaded rod threaded over substantially the entire length of the rod. For example, there could also be a nut, such as a lock nut where the fixed hex head is shown in the exemplary mandrel and abrasive device assembly 100 of FIG. 1. It is only important that it be possible to provide a linear compression force to each disc mandrel such that a radius of the disc mandrels can be adjusted. Typically, the radii of the disc mandrels of a mandrel and abrasive device assembly are adjusted together by adjusting the linear force on the plurality of disc mandrels together with one convenient adjustment (e.g. a nut). However, there could also be embodiments where individual disc mandrel radius, or subsets of disc mandrels are adjusted individually, such as by one or more additional adjusting nut on threaded sections of the rod central member.

Focusing the conversion of the linear compression force to the relatively small circular (circumferential) contact surface of a plurality of mandrels provides the necessary cleaning action needed to more effectively remove contaminants such as carbon combustion by-products, from the rifling of a gun barrel, as compared with cylinders of the prior art. For example, in some embodiments, as contrast with an expanding cylindrical member of the prior art, each disc mandrel has a width along an axis of said central member at about said center cylindrical wall (disc mandrel axial length) which is at least two times greater than a width of an outer edge surface of the disc mandrel at an outside radius of the disc mandrel about in said the plane of the disc (the disc plane). In other words, the surface contact width of the outside edge of the disc mandrel which directly contacts the inside surface of the gun bore including any interior rifling, is at least two times narrower that the width of the disc mandrel near the central member.

An abrasive section 103 is typically a component of a mandrel and abrasive device assembly. For example, a brush section is most commonly used. The abrasive section 103, such a wire brush, is typically mounted on the opposite side of the linear compression nut 107. However, there could also be embodiments where the abrasive section 103 can also convert a linear compression to a radius adjustment to also vary the pressure of the abrasive element against the interior surface of the bore being cleaned. Yet other embodiments can supplement or replace the wire brush with any suitable abrasive material. There can also be more than one abrasive section 103 either on the same side of the disc mandrels as shown in FIG. 1, or on either side of the plurality of disc mandrels.

In some embodiments, each disc mandrel 101 is made by joining two cup sections 102.

Figure 2:
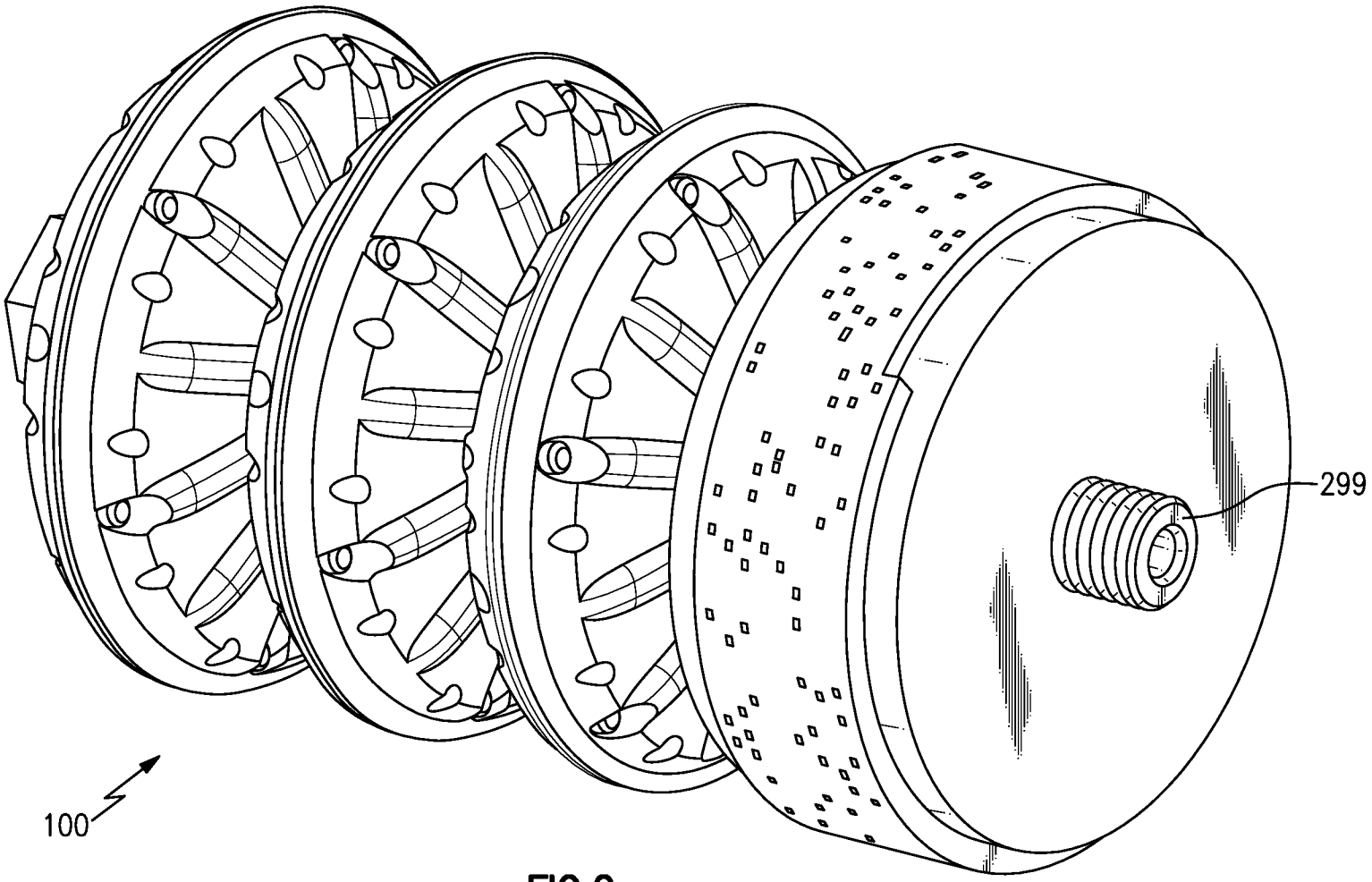
FIG. 2 is a drawing showing a perspective view of the gun cleaning apparatus of FIG. 1 from an opposite brush end.

FIG. 2 shows a perspective view of the gun cleaning apparatus of FIG. 1 from an opposite brush end. A threaded rod 299 can be seen as the central member from the brush end in FIG. 2. The central member need not necessarily be continuous past the adjusting nut. For example, another section can be threadingly or otherwise mechanically coupled to the central member past the adjusting nut, such as, to accommodate one or more abrasive sections 103.

Figure 3:
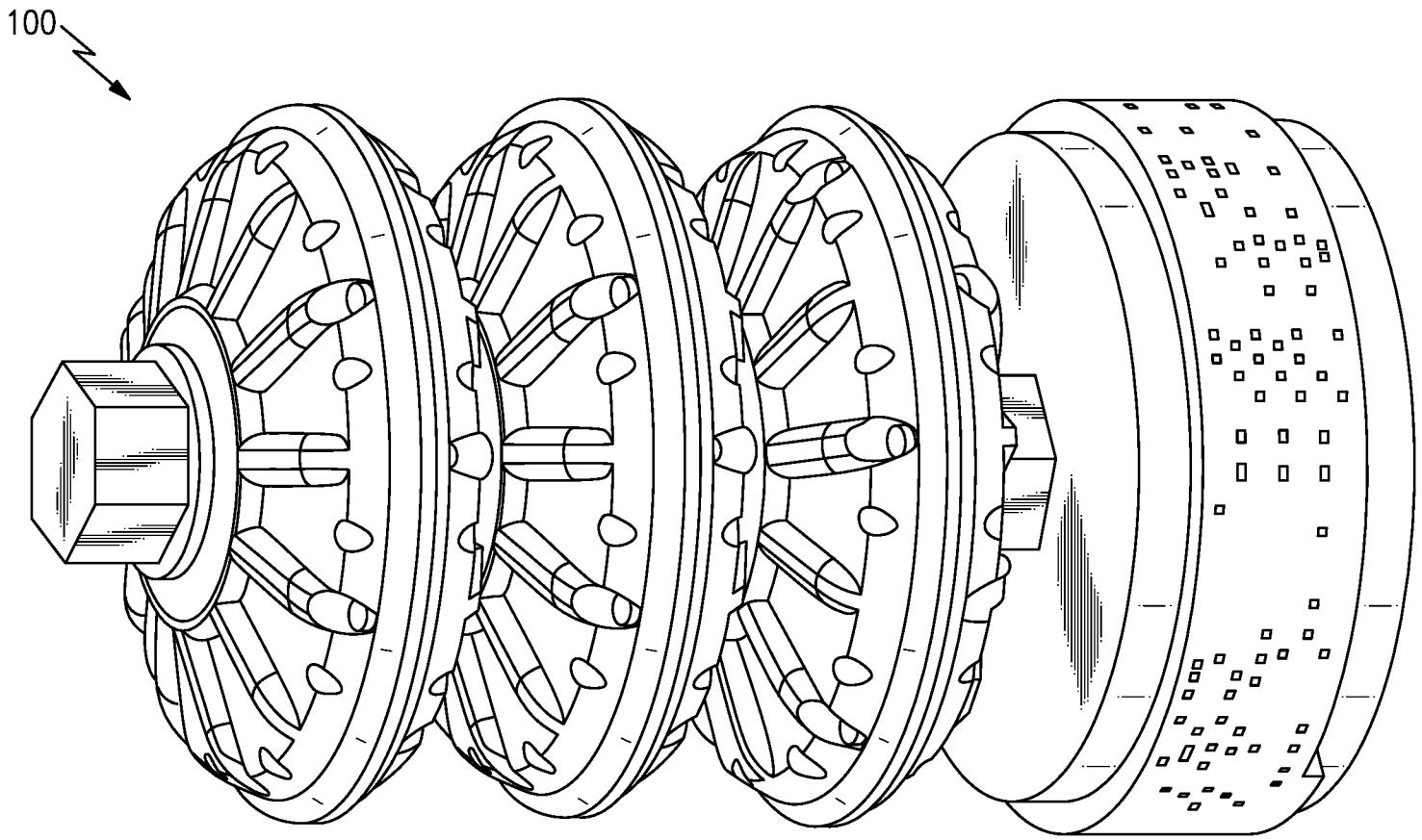
FIG. 3 is a drawing showing a side view of the gun cleaning apparatus of FIG. 1.

FIG. 3 shows a side view of the gun cleaning apparatus of FIG. 1.

Disc Mandrel Cup Sections

Figure 4:
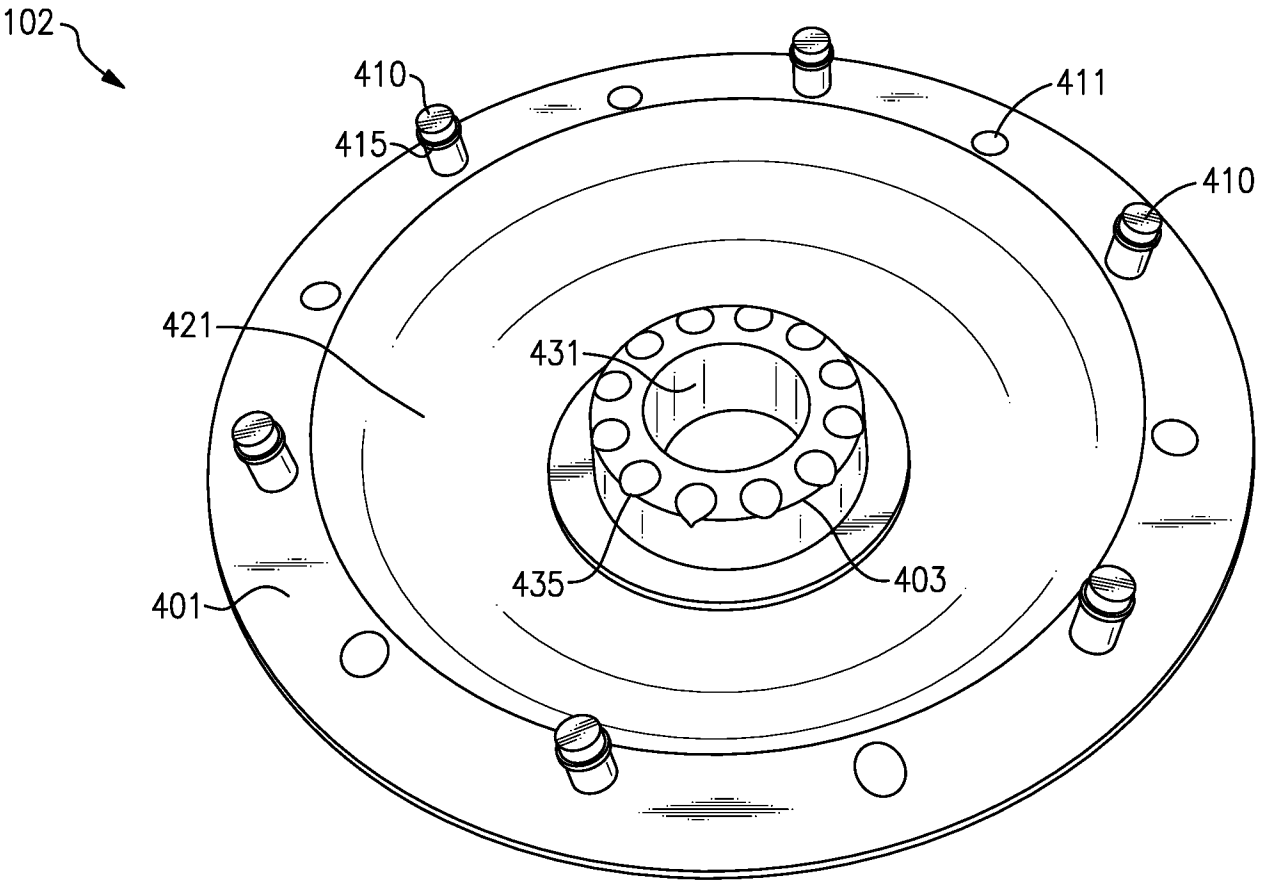
FIG. 4 is an illustration showing an exemplary implementation of the cup section of FIG. 1.

FIG. 4 is an illustration showing an exemplary implementation of a cup section 102 of each disc mandrel 101 of FIG. 1. At the center of the cup section is a cylindrical section 403. The cylindrical wall 431 of cylindrical section 403 defines a mounting hole in each cup section 102. The axial length of the cylindrical section 403 may protrude into the space formed by a cup spaced inner surface 421. An extended length cylindrical section 403 may be used as a stop against an adjoining cups section in order to limit the axial compression of the mandrel. Limiting the axial compression of the mandrel prevents inadvertent over tightening of the adjustment nut that may result in damage to the gun cleaning apparatus, a mandrel or an individual cup section. The two cup sections 102 can be slid over any suitable central member, such as a threaded rod, or rod with threaded sections (central member not shown in FIG. 4). The two cup sections 102 join at a cup section mating surface 401. The alignment of the two cup sections 102 of the resulting disc mandrel 101 can be enhanced by posts 410 which are inserted into sockets 411 when two cup sections are joined to make a disc mandrel 101. Posts 410 can optionally include an expanded section 415 to help lock the two cup sections together. In some embodiments, there can also be holes distributed around cylindrical section 403, the holes being disposed about in a long direction of the axis of the central member. Such holes 435 can help the cylindrical section 403 to maintain an about cylindrical shape during the linear compression along the central member axis to set a desired disc mandrel 101 radii. Each cup section 102 also includes a hollow part defined by a cup shaped inner surface 421. Any suitable shape, such a more rectangular shape can be used. The purpose of the hollow part is to help translate the linear compression at the central member (more compression to flatten or less compression to widen each disc mandrel 101) to a larger disc mandrel 101 radius with more linear compression or a smaller disc mandrel 101 radius with less linear compression.

Typically, each hollow part of a disc mandrel 101 is filled with air and during adjust of the disc mandrel 101 radii there is air exchanged between the hollow part and the atmosphere. The set radii and shape of each disc mandrel 101 can be maintained by the structure of the two cup sections 102, including the cylindrical sections 403 and cup section mating surfaces 401. However, in some embodiments there could also be a sealed or partially sealed void which contains air, a gas, a mixture of gases, a compressible solid or foam, or a liquid. Each of the disc mandrels 101 has a range of radii by virtue of the translation of linear compress along the central member to a variable radius in the disc plane. However, there can also be manufactured different radius disc mandrels for different gun bores.

For example, there can be dedicated exemplary gun cleaning mandrel and abrasive gun cleaning tool according to the Application for 120 mm to 105 mm series gun bores and another for the 155 mm gun bore.

Disc mandrels 101 (including embodiments made from two cup sections 102) can be formed from a thermoplastic by any suitable thermoplastic manufacturing technique, such as, for example, thermoplastic molding. However, the disc mandrels can also be made from any suitable material, typically a material that offers some compressibility so that once adjustably compressed (e.g. by nut 107) the combination of the compressed sheath and cylindrical double coned sheathed pressure sections provide an adjustable outward pressure perpendicular to the center line of the bore so as to force the cleaning sheath against the interior surface of the bore (smooth or rifled) so that the sheath is forced against the interior surface as the sheathed cylindrical double coned pressure sections are pulled through the barrel. For example, the disc mandrels and/or cup sections can be formed of a thermosetting rubber polymer, such as by injection molding, or a thermoplastic polymer in an injection molding machine. Any suitable material, such as for example, any suitable thermoplastic elastomer can also be used.

Figure 5:
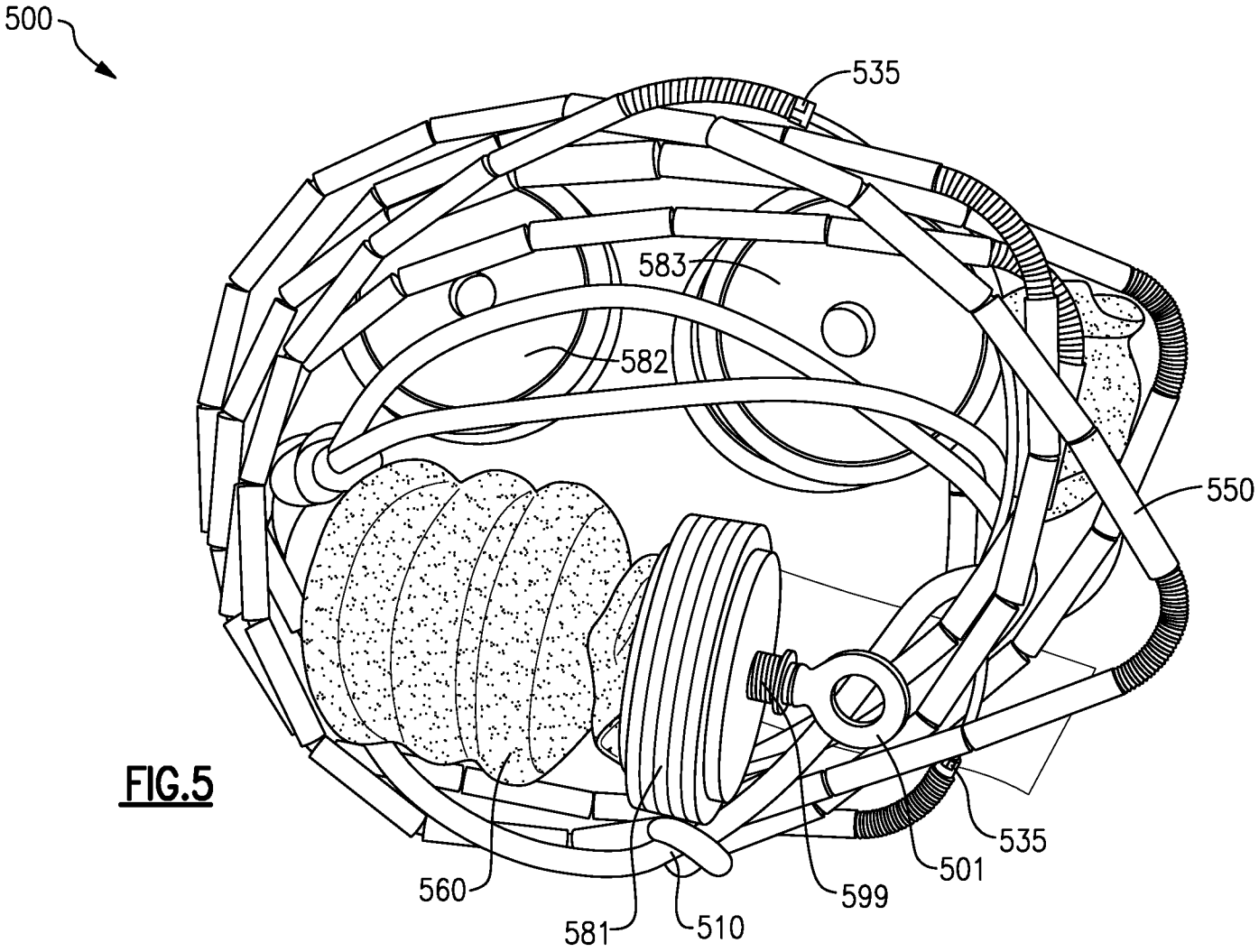
FIG. 5 is an illustration showing an exemplary implementation of a large bore gun cleaning apparatus with expanding disc mandrels.

FIG. 5 is an illustration showing an exemplary implementation of a large bore gun cleaning apparatus 500 with expanding disc mandrels based on the mandrel and abrasive device assembly 100 of FIG. 1. An eyelet 501 can be seen mechanically coupled to an end of the central member 599 for pulling and/or pushing the mandrel and abrasive device assembly 100 through the bore of a gun. For example, in some embodiments, the mandrel and abrasive device assembly can be inserted at the breach end of a large gun, then pulled towards the muzzle end. In some embodiments, there can be an eyelet or equivalent connection point at either end of the too, or at both ends of the tool, so that the mandrel and abrasive device assembly can be pulled or pushed from either end from breach to muzzle, or from muzzle to breach.

Any suitable cord, cable, or rod can be used to pull and/or push a mandrel and abrasive device assembly through the bore of the barrel of a gun. In some embodiments, a twisted cord can be used as shown by cord 510 in FIG. 5. Alternatively, a new type of coilable semi-rigid cable 550 can be used. The coilable semi-rigid cable 550 is described in more detail hereinbelow.

A sock 560 can be seen covering the disc mandrels of the mandrel and abrasive device assembly in FIG. 5. Typically, the sock does not extend over the abrasive element. Any suitable sock material, weave, fabric can be used for sock 560. Sock 560 can be used to apply solvents, liquid abrasives, and/or preservative liquids or compounds to the inside surface of the barrel of a gun. Sock 560 can also help to collect for removal any deposits or debris dislodged from inside surface or from the rifling indentations or pattern of the inside surface of the barrel by brush 581 or any other suitable abrasive element 103.

Sock 560 can be woven of primarily a natural fiber such as cotton, although synthetic fiber can be included; and 100% synthetic fiber is fully comprehended by the invention. Many natural fibers are sufficiently absorbent to retain adequate amounts of cleaning solvent without the need for sections of additional absorbent sponges between the sheath and the core. Additional special-purpose threads, such as fiber-optic, phosphorescent or luminescent threads, can also be woven into the sheath to provide, for example, auxiliary lighting for visual inspection of a gun barrel for cleanliness as the mandrel and abrasive device assembly is withdrawn. The sock can also include fibers of heat resistant materials, such as meta-aramids, NOMEX, para-aramids, KEVLAR, fiberglass, K-fiber, or the like. In some embodiments, synthetic fibers, such as nylon, polystyrene, acetals, acrylics or the like, or metallic thread, such as brass or the like, can be incorporated into the sheath to increase the abrasive characteristic of the sheath to assist in removal stubborn residue from the barrel. Sock 560 can be woven, for example, on a tubular commercially available braiding machine.

As shown by abrasive elements 103, FIG. 1, brushes 581, 582, and 583 can be interchanged on threaded rod 599. Brushes 581, 582, and 583 can be same type replacements, different types of brushes (or, other suitable abrasive elements), or of slightly different diameters for different diameter bores, where the abrasive element 103 typically has a fixed, non-adjustable radius.

Push/Pull: In the exemplary embodiment of FIG. 5, eyelet 501 provides a pull and/or push coupling point for a cord, rope, or rod. The eyelet 501 is typically threadedly removable for changing the abrasive element 103. It is unimportant how the eyelet couples to the rod or central member. For example, the eyelet can have a stud with male threads or a socket with female threads corresponding to an opposite mating threaded arrangement on the rod. However, any suitable alternative can also be used, such as, for example a removable bayonet fitting or any other suitable type connector.

In some embodiments, the gun cleaning apparatus further includes a second mechanical coupling disposed at an opposite end of the mandrel and abrasive device assembly from a first mechanical coupling apparatus. For example, there can be scrubbing back and forth, such as breech to muzzle, and muzzle to breech, where at least two different operating personnel are at both ends of the bore being cleaned pulling and/or pushing about simultaneously with ropes, cables, or rods from either end of the barrel.

Figure 6:
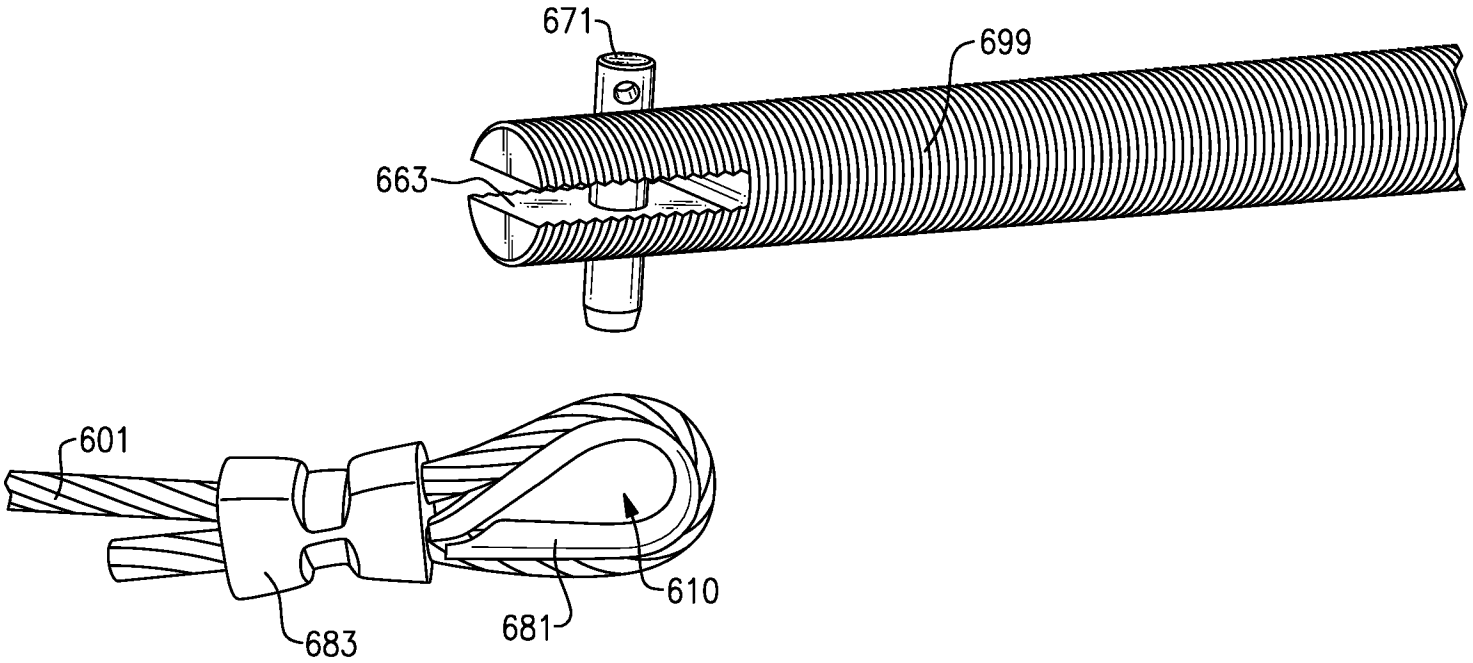
FIG. 6 is an illustration showing an alternative connection point for a cable to the central member.

FIG. 6 is an illustration showing an alternative connection point for a cable 601 to the central member 699. Central member 699 includes at one end a slot 663 and a hole 661 perpendicular to the slot 663 which accepts a pin 671. The cable 601, such as, for example, a wire cable, can have at one end a loop 610, such as, formed by a crimp (e.g. by a crimp or swaged double barrel sleeve 683 or ferrule, or oval sleeve or ferrule). In some embodiments, the loop can be reinforced by a metal thimble 681. The sleeve or ferrule, and thimble can be made from any suitable metal, including, for example, aluminum, steel, stainless steel, copper, or any combination thereof. Such metals may include any suitable coating, such as a zinc coating, or be processed for corrosion resistance, such as a galvanized metal by a galvanization process. Similarly, the exemplary slotted threaded rod of FIG. 6 can be replaced by any suitable coupling, such as, for example, any suitable clevis joining structure and method. In some embodiments, the clevis can be narrow enough to allow an abrasive element 103 to slide over it.

Figure 7A:
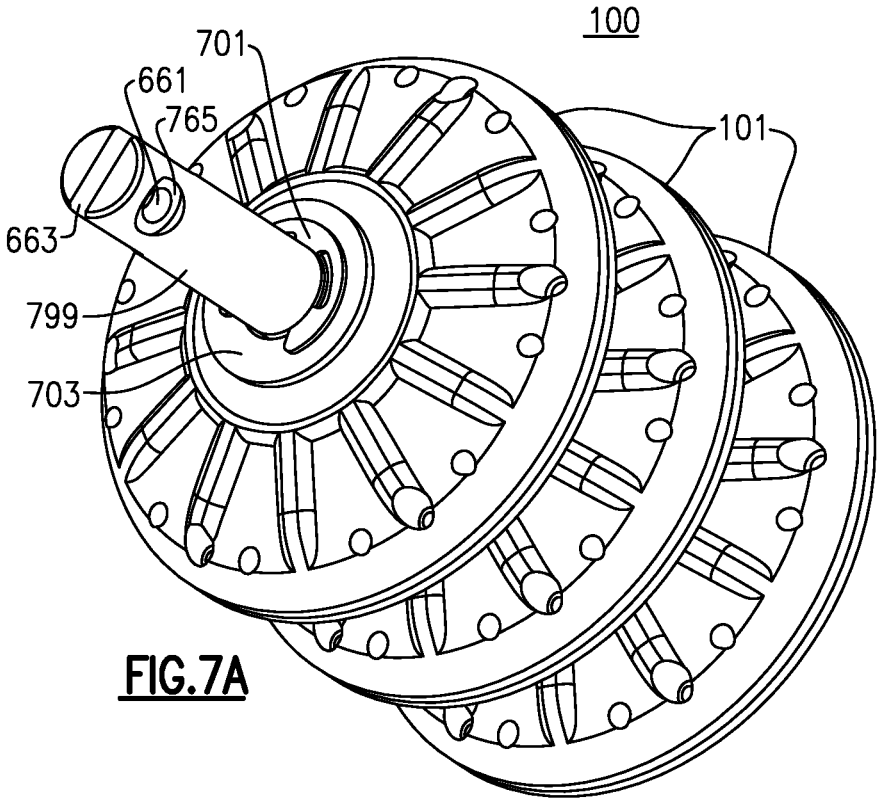
FIG. 7A is a drawing showing a perspective view of another exemplary gun cleaning mandrel and abrasive device assembly.
Figure 7B:
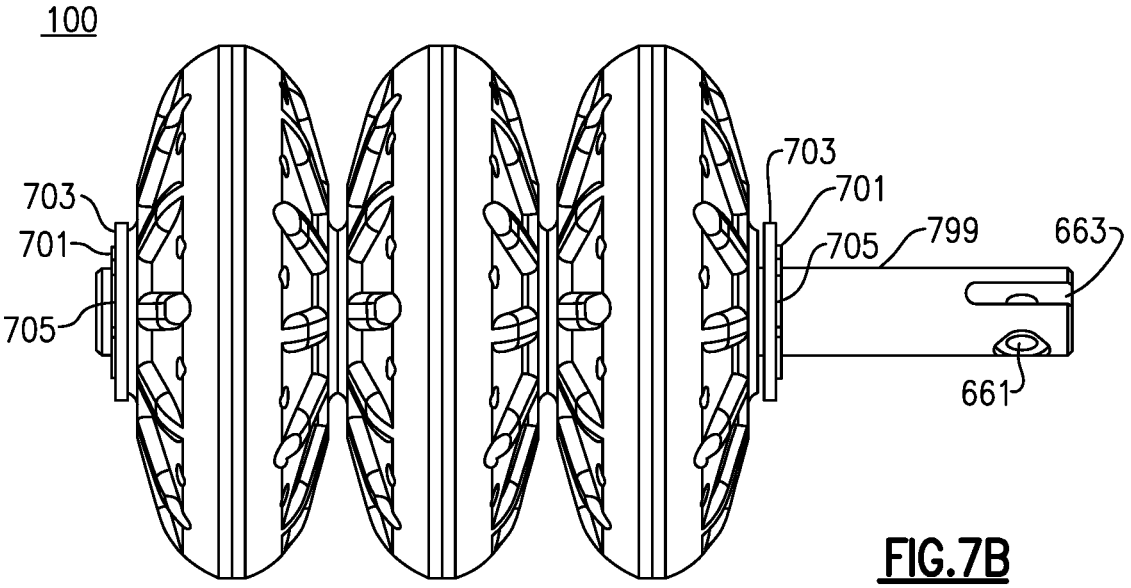
FIG. 7B is a drawing showing a side view of the assembly of FIG. 7A.

Snap ring and slot: FIG. 7A is a drawing showing a perspective view of another exemplary gun cleaning mandrel and abrasive device assembly 100 with expanding disc mandrels 101. FIG. 7B is a drawing showing a side view of the gun cleaning mandrel and abrasive device assembly of FIG. 7A. What is different from FIG. 1 to FIG. 6 is that instead of a threaded rod 299, a slotted shaft 799 provides at least one circumferential notch 705 which accepts any suitable snap ring as an end stop, such as, for example, E snap ring 701. Acting alone, or more typically against a washer 703, the fixed position on slotted shaft 799 determines the linearly compression of the disc mandrels 101 to provide at least one desired disc mandrel radius.

At one end a slot 663 and hole 661 perpendicular to the slot 663 which can accept a pin, screw, or bolt to attached to a pulling or pushing cable or rod similar to the structure of FIG. 6. An optional counter sunk ledge 765 can provide a flat surface for a fastener head, washer, fastener shoulder, or lock washer.

Figure 8A:
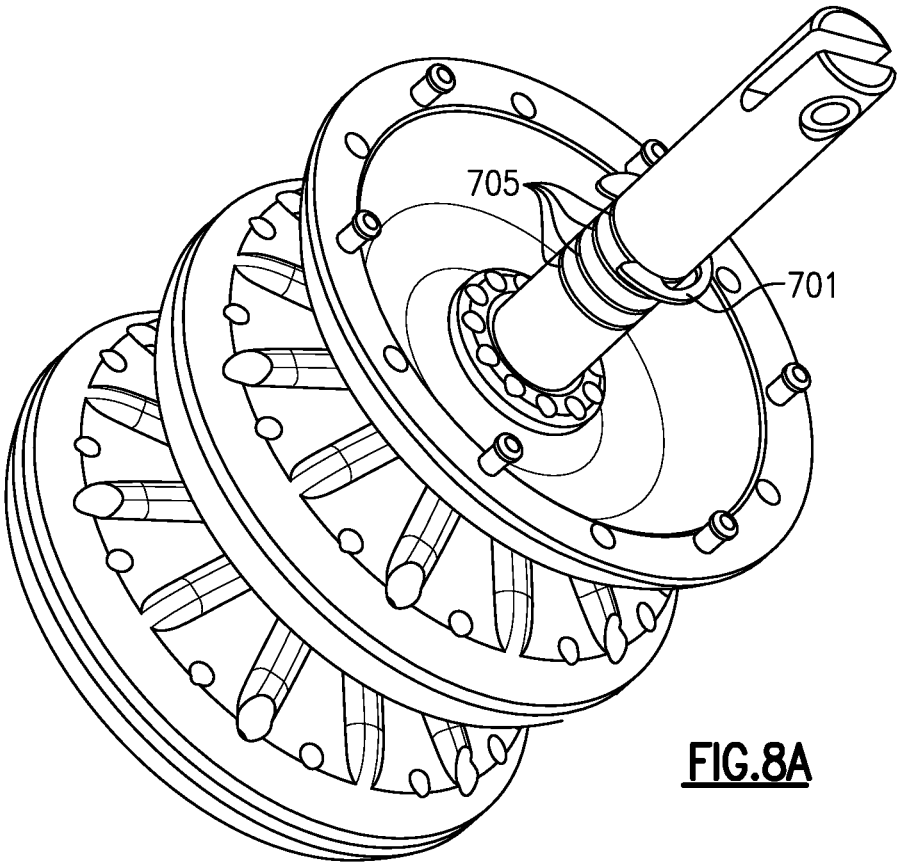
FIG. 8A is a drawing showing a section view of the gun cleaning mandrel and abrasive device of FIG. 7A.
Figure 8B:
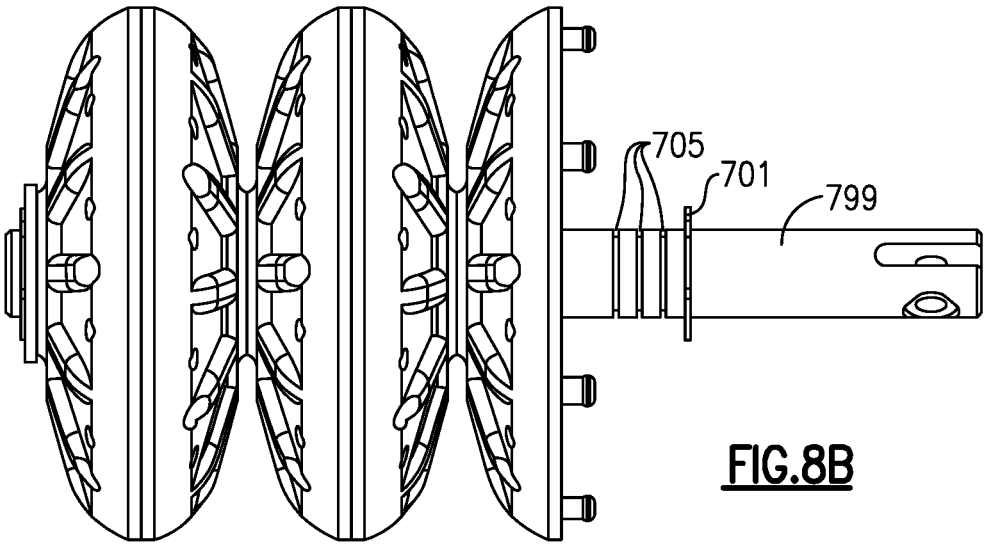
FIG. 8B is a drawing showing a side view of the assembly of FIG. 8A.

FIG. 8A is a drawing showing a section view of the gun cleaning mandrel and abrasive device of FIG. 7A. FIG. 8B is a drawing showing a side view of the gun cleaning mandrel and abrasive device assembly of FIG. 8A. Typically, there are at least two circumferential notches 705 to provide an adjustment, such as between the two fixed circumferential notches 705. In the example of FIG. 8A, there are four circumferential notches 705, a series of grooves or slots in slotted shaft 799 which can be seen by the artistic removal of one of the cup sections 102 of the disc mandrels 101 nearest a pull or push end for the sectional view. The plurality of circumferential notches 705 at predetermined positions on slotted shaft 799 provides a variety of slot locations which can accept a snap ring. Each of the circumferential notches 705 provides a different linearly compression of the disc mandrels 101 to provide a plurality of different disc mandrel radii. Any suitable number of circumferential notches 705 can be present. Circumferential notches 705 can be milled from slotted shaft 799 at time of manufacture, however any suitable manufacturing technique can be used. The spaced apart locations of the circumferential notches 705 are fixed at time of manufacturer in any suitable arrangement to achieve a series of optional radial settable sizes. The spacing can be about linear with about equal spacing, or nonlinear, where there are different distances between three or more circumferential notches 705. The spacing can be different, or the spacing can be, for example, a progression of successively closer together circumferential notches 705, such as where the compression increases for greater disc mandrels 101 radius. As described hereinabove, each of the settable (adjustable) sizes provided by each circumferential notch 705 provides a different axial pressure on mandrels to provide a settable radial size by radial expansion of each of the disc mandrels 101.

The expanding disc mandrels 101 can also be spring biased to an expanded position, wider with less radial size. For example, there can be one or more springs disposed within and between each of the cup sections 102 to accomplish such a spring bias. The springs can be of any suitable type, typically one or more compression springs. Any suitable type of compression spring made from any suitable material can be used. There can be one compression spring disposed within each mandrel around a rod central member. Or, there can be any suitable number of compression springs disposed at any suitable locations between the two cup sections of each mandrel, typically in the linear direction of the central member, the same as the direction of linear compression of the group of mandrels.

Figure 9:
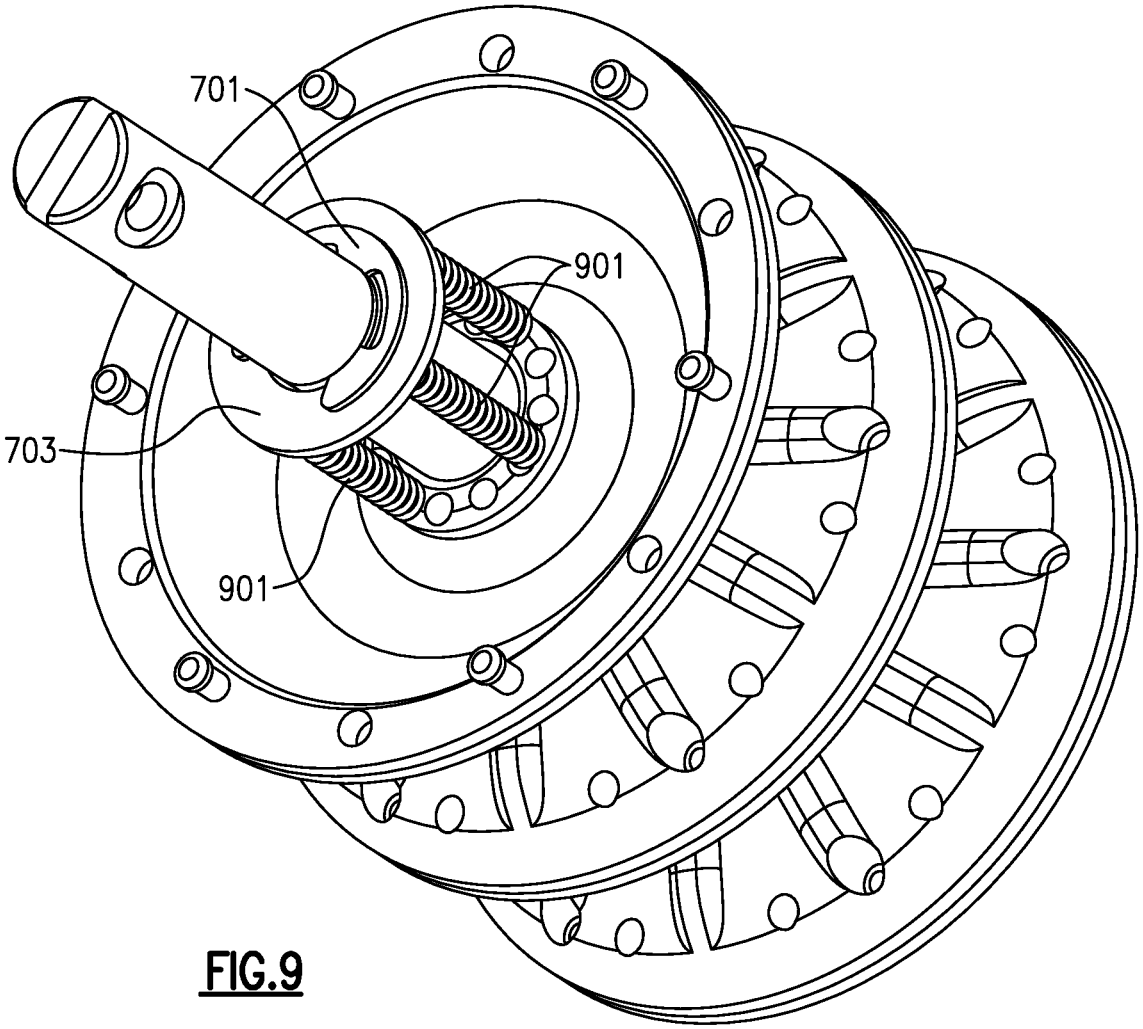
FIG. 9 shows a perspective drawing of a sectional view of an exemplary mandrel and abrasive device assembly according to FIG. 7A.

FIG. 9 shows a perspective drawing of a sectional view of an exemplary mandrel and abrasive device assembly 100 according to FIG. 7A and FIG. 7B having an exemplary four springs 901 disposed about circumferentially along an internal radius smaller than the diameter of the expanding disc mandrels 101, here roughly coincident with the radius of cylindrical section 403. The ends of the springs shown under the washer 703 would typically be in contact with the cylindrical section 403 of the cup section 120 which has been artistically removed from sectional view of FIG. 9 to show the springs otherwise not visible, as disposed internally within the disc mandrel 101.

Coilable Semi-Ridged Cable

One problem with the relatively long barrel of large military guns is feeding a pull cord through the barrel, such as from the muzzle opening to the breach. Even steel cables can bend and become fouled or caught before exiting the barrel at an opposite end. What is needed is a coilable semi-ridged cable, especially useful, for example, for many 155 mm type guns. The cable should be coiled for relatively compact storage, but extendable into a semi-ridged cable to be threaded with minimal effort through the barrel of a gun.

Applicant realized a new type of gun cleaning cable based on ridged segments and springs over a wire cable to solve the problem of the need for a coilable semi-ridged cable.

Figure 10A:
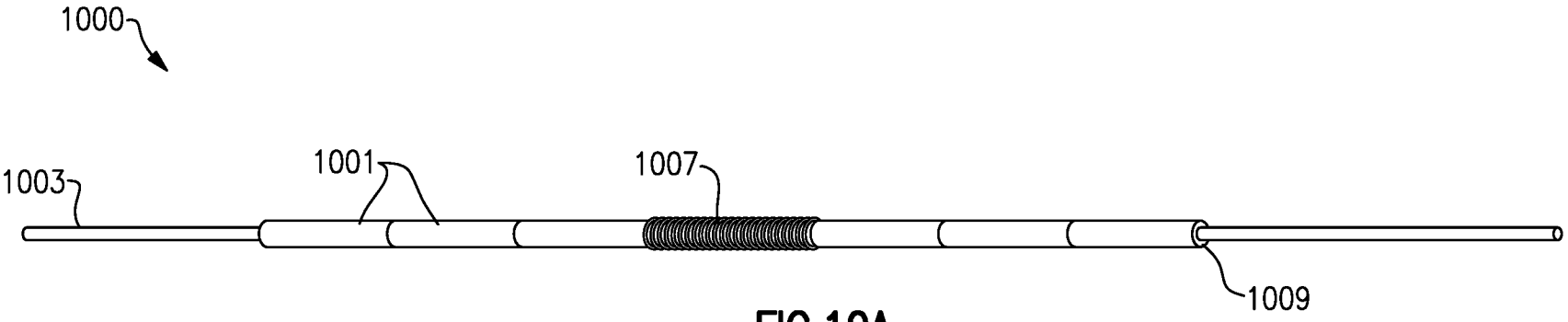
FIG. 10A shows an exemplary embodiment of a coilable semi-ridged cable.

FIG. 10A shows an exemplary embodiment of a coilable semi-ridged cable 1000. The central member can be any suitable wire or rope. In the exemplary embodiment 1000, the central member is a nylon covered wire cable 1003. Wire cables or wire ropes are well known and can be made from one or more strands of twisted wires. Also, a coating if any (e.g. nylon), is unimportant to the new coilable semi-ridged cable. Tubular sections 1001 are slidingly mounted over the cable 1003. The tubular sections are held captive by end stops (not shown in FIG. 10A, see FIG. 5, 535). Any suitable end stops can be used to prevent further travel outwards on either side by the tubular sections. Spring 1007 is also slid over the cable 1003 so that it is between groups of tubular sections. The tubular sections each have opposing end faces 1009, where each end face is substantially perpendicular to the long axis of the cable. The end faces can be about flat or of any suitable shape where there is a contact surface between adjacent perpendicular surfaces. When extended straight in a semi-ridged position, there is a spring bias on the tubular sections forcing the tubular sections towards either end stop (not shown in FIG. 10A, see FIG. 5, 535). Because the end faces 1009 are substantially perpendicular to the cable long axis, the tubular sections 1001 force the cable to be substantially straight along the cable long axis.

The coating over a central member, typically a wire rope, can be formed form any suitable material, such as, for example, nylon, vinyl, plastic, or any other suitable material.

Any suitable end stops can be used. For example, the exemplary end stops 535 of FIG. 5 are metal crimped end stops, crimped on a nylon covered wire rope.

Figure 10B:
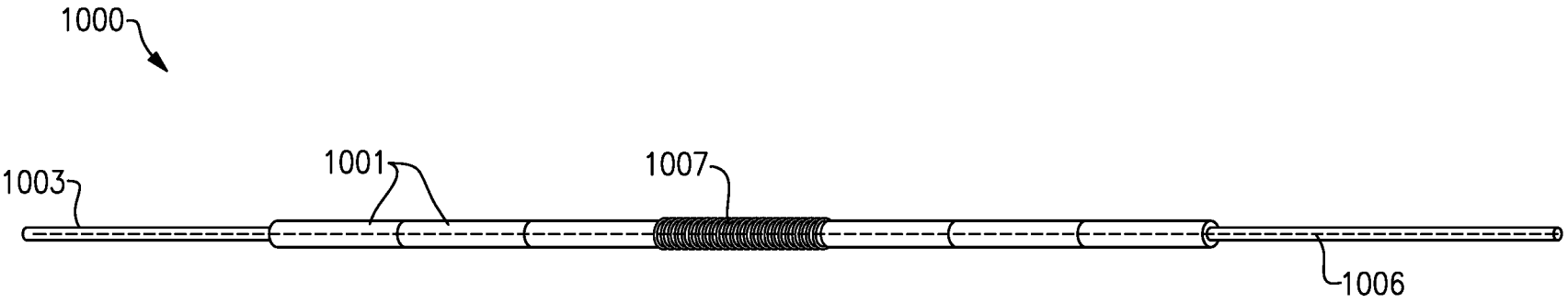
FIG. 10B shows an exemplary embodiment of the coilable semi-ridged cable of FIG. 7A.

FIG. 10B shows an exemplary embodiment of the coilable semi-ridged cable of FIG. 10A with the cable long axis 1006.

When coiling a coilable semi-ridged cable 1000, the cable is rolled overcoming the spring bias holding the tubular section faces together. In the coiled state, the spring is more compressed than in the semi-ridged position. Depending on the force imparted by the spring bias, spring 1007 can also help to force the coilable semi-ridged cable 1000 from a stowed coil into the straight semi-ridged cable as it is removed from a storage compartment and unwound.

Figure 11:
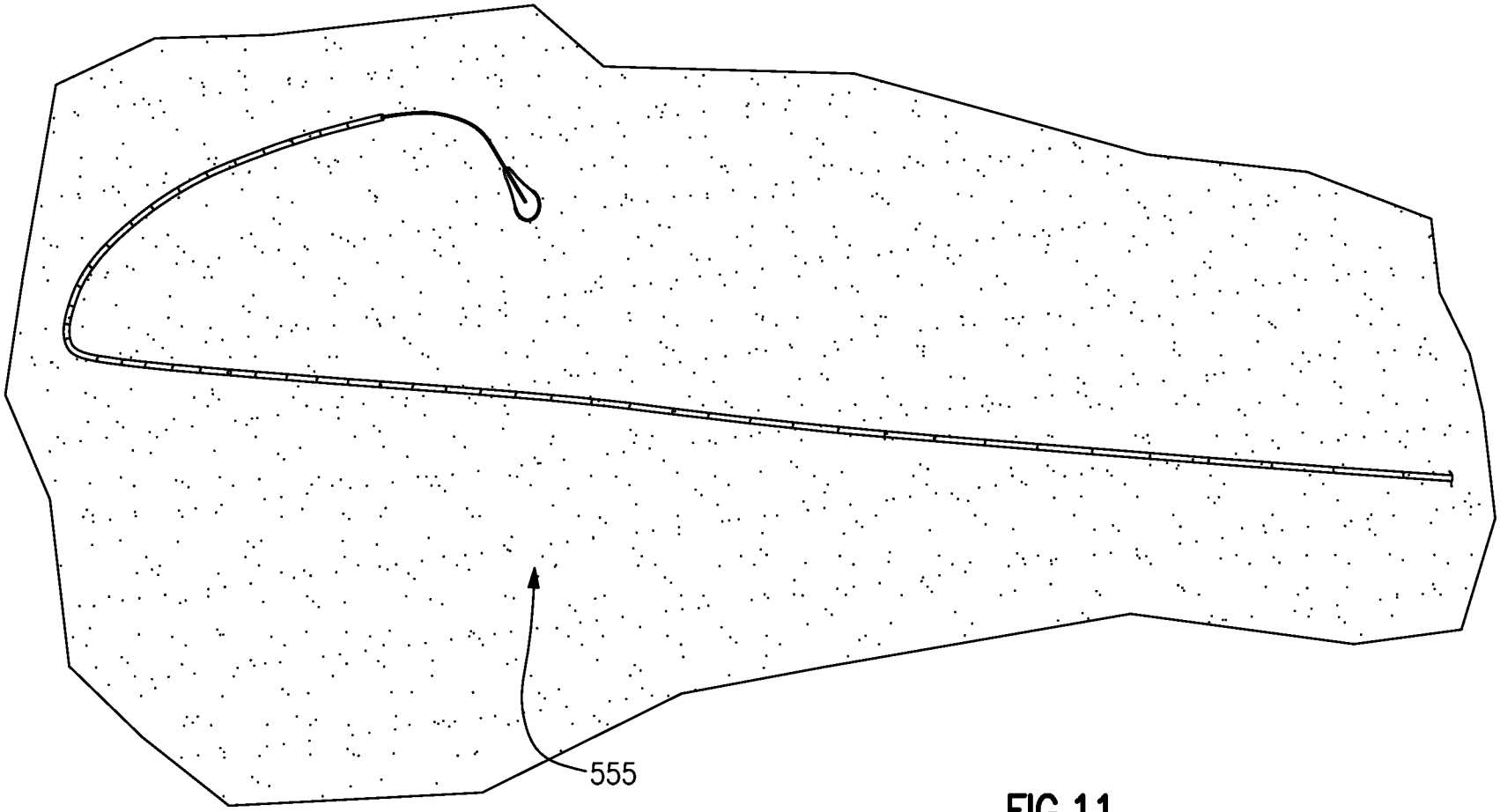
FIG. 11 shows another exemplary embodiment of a semi-ridged cable.

FIG. 11 shows another exemplary embodiment of a semi-ridged cable 555 from FIG. 5. In the embodiment of FIG. 5, FIG. 11, there are one or more springs between several groups of tubular sections. There can also be springs at each end stop as shown in FIG. 11.

Chinese Finger Trap Pull Advance and Pull System

Some gun barrels are in close quarters, where it may be difficult to insert and advance either by push or pull, or both push and pull a conventional cable, rod, or segmented semi-ridged cable. It was realized that a Chinese finger trap device can be adapted to pull a rod or other similar cylindrical or rod like central member through a gun bore in close quarters. The Chinese finger trap solution allows for relatively easy advance of the pull cord end with each cleaning pull, to further advance a gun bore cleaning tool through a gun barrel in close quarters. When through the bore, the Chinese finger trap can be easily removed from the central member of the cleaning device by compression the conventional manner to slide the Chinese finger trap from the central member. It was realized that there is a new use for such Chinese finger trap devices, as have been intended for use, for example, as bus drop grips to support cable weight and to relieve tension or to dampen vibration in hanging runs of cable, rod, and tubing. Such cable-support grip devices are available, for example, from McMaster-Carr of Aurora, Ohio.

Figures 12A, 12B:
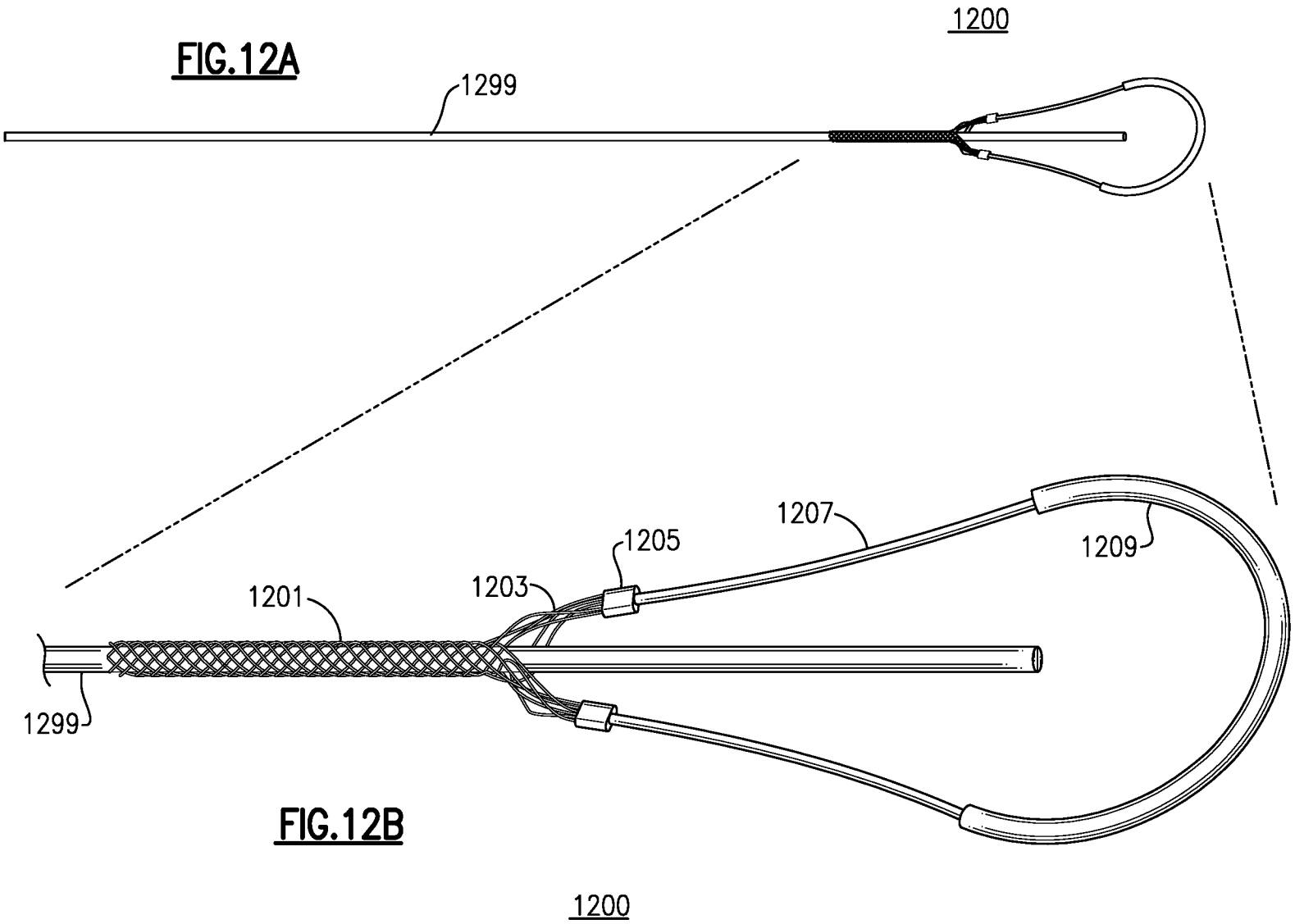
FIG. 12A is a drawing of an exemplary close quarters or limited space Chinese finger trap pull advance and pull system for a central member.
FIG. 12B is a drawing showing a more detailed view of the Chinese finger trap of FIG. 12A.

FIG. 12A is a drawing of an exemplary close quarters or limited space Chinese finger trap pull advance and pull system 1200 for a central member 1299. Central member 1299 can be any suitable central member (e.g. threaded rod 299 which is typically only threaded over certain portions of the rod, and slotted shaft 799).

FIG. 12B is a drawing showing a more detailed view of the exemplary Chinese finger trap of FIG. 12A. The wires of the Chinese finger trap terminate in crimp connectors 1205 and transition to loop cable 1207 which can have any suitable cladding or over layer, such as for example, tubing 1209.

In summary, a gun cleaning apparatus includes a central member (e.g. FIG. 2, 299, FIG. 5, 599, FIG. 6, 699, FIG. 7A, 799) and a plurality of disc mandrels (e.g. 101). Each disc mandrel has a center cylindrical wall substantially perpendicular to a disc plane. The central member passes through a hole in each of the disc mandrels defined by the center cylindrical wall. The plurality of disc mandrels is stacked adjacent to one another on the central member. A central member end stop (e.g. FIG. 1, 105, FIG. 7B, left side, 701) is disposed at one end of the central member against a first side of a first disc mandrel. An adjustable end stop (e.g. FIG. 1, 107, FIG. 8A, 701, 705) is disposed on the central member about adjacent to a second side of a last disc mandrel. The adjustable end stop has a linear position adjustable in a compression direction, from a first level of linear compression of the plurality of disc mandrels setting a first radii of the disc mandrels in the disc plane, to a second level of linear compression different than the first level of linear compression of the plurality of disc mandrels, setting a second radii of the disc mandrels in the disc plane different than the first radii. At least one mechanical coupling is disposed at an end of the central member to accept a cord or rod (e.g. FIG. 5, FIG. 6, FIG. 7A, FIG. 10A, FIG. 10B, FIG. 11, FIG. 12A, FIG. 12B).

One exemplary pull cord is a coilable semi-ridged cable pull cord (e.g. coilable semi-ridged cable 1000) for a gun cleaning apparatus includes a cable. A first end stop 1005 and a second end stop 1005 are non-slidingly coupled to the cable at different locations. A plurality of tubular sections 1001 is slidingly disposed on the cable between the first end stop 1005 and the second end stop 1005. Each tubular section 1001 includes an end face 1009 about perpendicular to a long axis of the tubular section 1001 at each of both ends of the tubular section. At least one spring 1007 is disposed either between an end stop 1005 and tubular section 1001 or disposed between two tubular sections 1001. In a coiled position, the at least one spring 1007 is in a first compressed state, and in a substantially straight position, the at least one spring 1007 is in a second compressed state with less spring force than the first compressed state.

Cascade

Disc Mandrel and abrasive device assemblies having any suitable number of disc mandrels and optionally one or more abrasive elements, can be daisy chained by any suitable interconnection links. For example, there can be eyelets or clevis and pins on the ends of two adjacent disc mandrel and abrasive device assemblies. Any suitable hooks or loops on cables, wire ropes, ropes, etc. can be used to mechanically couple two disc mandrel and abrasive device assemblies. Strings or cascades of any suitable number of two or more disc mandrel and abrasive device assemblies can be so formed.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A gun cleaning apparatus comprising:

a central member;

a plurality of disc mandrels, each disc mandrel having a center cylindrical wall substantially perpendicular to a disc plane, said central member passing through a hole in each of said disc mandrels defined by said center cylindrical wall, said plurality of disc mandrels stacked adjacent to one another on said central member, and each disc mandrel of said plurality of disc mandrels comprising two cup sections affixed to each other in said disc plane;

a central member end stop disposed at one end of said central member against a first side of a first disc mandrel;

an adjustable end stop disposed on said central member about adjacent to a second side of a last disc mandrel, said adjustable end stop having a linear position adjustable in a compression direction, from a first level of linear compression of said plurality of disc mandrels setting a first radii of said disc mandrels in said disc plane, to a second level of linear compression different than said first level of linear compression of said plurality of disc mandrels, setting a second radii of said disc mandrels in said disc plane different than said first radii; and at least one mechanical coupling disposed at an end of said central member to accept a cord or rod.

2. The gun cleaning apparatus of claim 1, wherein said central member comprises a slotted shaft with at least two or more selectable circumferential notches and at least one snap ring as said adjustable end stop.

3. The gun cleaning apparatus of claim 1, wherein said central member comprises a rod having at least one threaded section and at least one nut as said adjustable end stop.

4. The gun cleaning apparatus of claim 1, wherein each disc mandrel comprises a width along an axis of said central member at about said center cylindrical wall which is at least two times greater than a width of an outer edge surface of said disc mandrel at an outside radius of said disc mandrel about in said disc plane.

5. The gun cleaning apparatus of claim 1, wherein said central member comprises a threaded rod or a rod threaded at least over a portion of said rod.

6. The gun cleaning apparatus of claim 1, wherein said central member extends past said adjustable end stop through an abrasive element.

7. The gun cleaning apparatus of claim 6, wherein said abrasive element comprises a wire brush.

8. The gun cleaning apparatus of claim 1, wherein said mechanical coupling comprises an eyelet.

9. The gun cleaning apparatus of claim 1, wherein said mechanical coupling comprises a slot in an end of said central member and a pin.

10. The gun cleaning apparatus of claim 1, wherein said mechanical coupling comprises a clevis and pin.

11. The gun cleaning apparatus of claim 1, wherein each cup section comprises a hollow part.

12. The gun cleaning apparatus of claim 1, wherein each cup section comprises a plurality of pins and sockets in said cup section mating surface in the disc plane, said pins and sockets alternating such that each pin of a first cup section fits into a corresponding hole of a second cup section when said first cup section and said second cup section are joined together to form said disc mandrel.

13. The gun cleaning apparatus of claim 1, wherein each cup section comprises one or more radial rib features.

14. The gun cleaning apparatus of claim 1, wherein each cup section comprises one or more radial slit features.

15. The gun cleaning apparatus of claim 1, wherein said adjustable end stop comprises a lock nut.

16. The gun cleaning apparatus of claim 15, wherein said lock nut comprises a nylon insert.

17. The gun cleaning apparatus of claim 1, further comprising a second mechanical coupling disposed at an opposite end of said central member to accept a cord or a rod.

18. The gun cleaning apparatus of claim 1, further comprising a coilable semi-ridged cable pull cord.

19. The gun cleaning apparatus of claim 1, further comprising a Chinese finger trap pull cord.

* * * * *